United States Patent [19]

Day et al.

[11] 4,186,702

[45] Feb. 5, 1980

[54] EXHAUST GAS RECIRCULATION CONTROL

[75] Inventors: Edward G. Day, Rochester; Thomas J. Hollis, Jr., Fairport, both of N.Y.

[73] Assignee: General Motors Corporation, Detroit, Mich.

[21] Appl. No.: 911,810

[22] Filed: Jun. 2, 1978

[51] Int. Cl.[2] ..... F02B 25/06

[52] U.S. Cl. ..... 123/119 A

[58] Field of Search ..... 123/119 A

[56] References Cited

U.S. PATENT DOCUMENTS

| | | | |
|---|---|---|---|
| 3,739,797 | 6/1973 | Caldwell | 123/119 A |
| 3,756,210 | 9/1973 | Kuehl | 123/119 A |
| 3,762,384 | 10/1973 | Day et al. | 123/119 A |
| 3,768,452 | 4/1973 | Lewis | 123/119 A |
| 3,783,848 | 1/1974 | Ranft | 123/119 A |
| 3,799,131 | 3/1974 | Bolton | 123/119 A |
| 3,800,765 | 4/1974 | Thompson | 123/119 A |
| 3,818,880 | 6/1974 | Dawson et al. | 123/119 A |
| 3,834,363 | 9/1974 | Goto | 123/119 A |
| 3,834,366 | 9/1974 | Kingsbury | 123/119 A |
| 3,880,129 | 4/1975 | Hollis, Jr. | 123/119 A |
| 3,881,456 | 5/1975 | Nohira et al. | 123/119 A |
| 3,896,777 | 7/1975 | Masaki et al. | 123/119 A |
| 3,915,136 | 10/1975 | Caldwell | 123/119 A |
| 3,931,813 | 1/1976 | Horie | 123/119 A |
| 3,970,061 | 7/1976 | Caldwell | 123/119 A |
| 3,973,535 | 10/1976 | Sugihara et al. | 123/119 A |
| 3,974,807 | 8/1976 | Nohira et al. | 123/119 A |
| 3,982,515 | 9/1976 | Bradshaw | 123/119 A |
| 4,006,721 | 2/1977 | Takagi et al. | 123/119 A |
| 4,009,700 | 3/1977 | Engels et al. | 123/119 A |
| 4,027,638 | 6/1977 | Moriya et al. | 123/119 A |
| 4,031,871 | 6/1977 | Hamanishi | 123/119 A |
| 4,033,308 | 7/1977 | Hayashi et al. | 123/119 A |
| 4,041,914 | 8/1977 | Sugihara et al. | 123/119 A |
| 4,041,917 | 8/1977 | Suzuki | 123/119 A |
| 4,044,735 | 8/1977 | Sumiyoshi | 123/119 A |
| 4,047,510 | 9/1977 | Nakajima et al. | 123/119 A |
| 4,056,084 | 11/1977 | Baumgartner | 123/119 A |
| 4,057,043 | 11/1977 | Harada | 123/119 A |
| 4,069,797 | 1/1978 | Nohira et al. | 123/119 A |
| 4,069,798 | 1/1978 | Thornburgh | 123/119 A |
| 4,071,006 | 1/1978 | Harada | 123/119 A |
| 4,073,202 | 2/1978 | Aoyama | 123/119 A |
| 4,079,710 | 3/1978 | Moriya et al. | 123/119 A |
| 4,090,482 | 5/1978 | Yoshida | 123/119 A |

FOREIGN PATENT DOCUMENTS 1380046 1/1971 United Kingdom .

*Primary Examiner*—Wendell E. Burns
*Attorney, Agent, or Firm*—C. K. Veenstra

[57] ABSTRACT

A transducer modifies a subatmospheric pressure signal to create an operating pressure which positions an exhaust gas recirculation control valve. A regulating unit senses subatmospheric induction passage pressure to provide the pressure signal and prevents the pressure signal from dropping below a lower limit to thereby establish the maximum exhaust gas recirculation area produced by the control valve.

3 Claims, 2 Drawing Figures

EXHAUST GAS RECIRCULATION CONTROL

Figure 1:
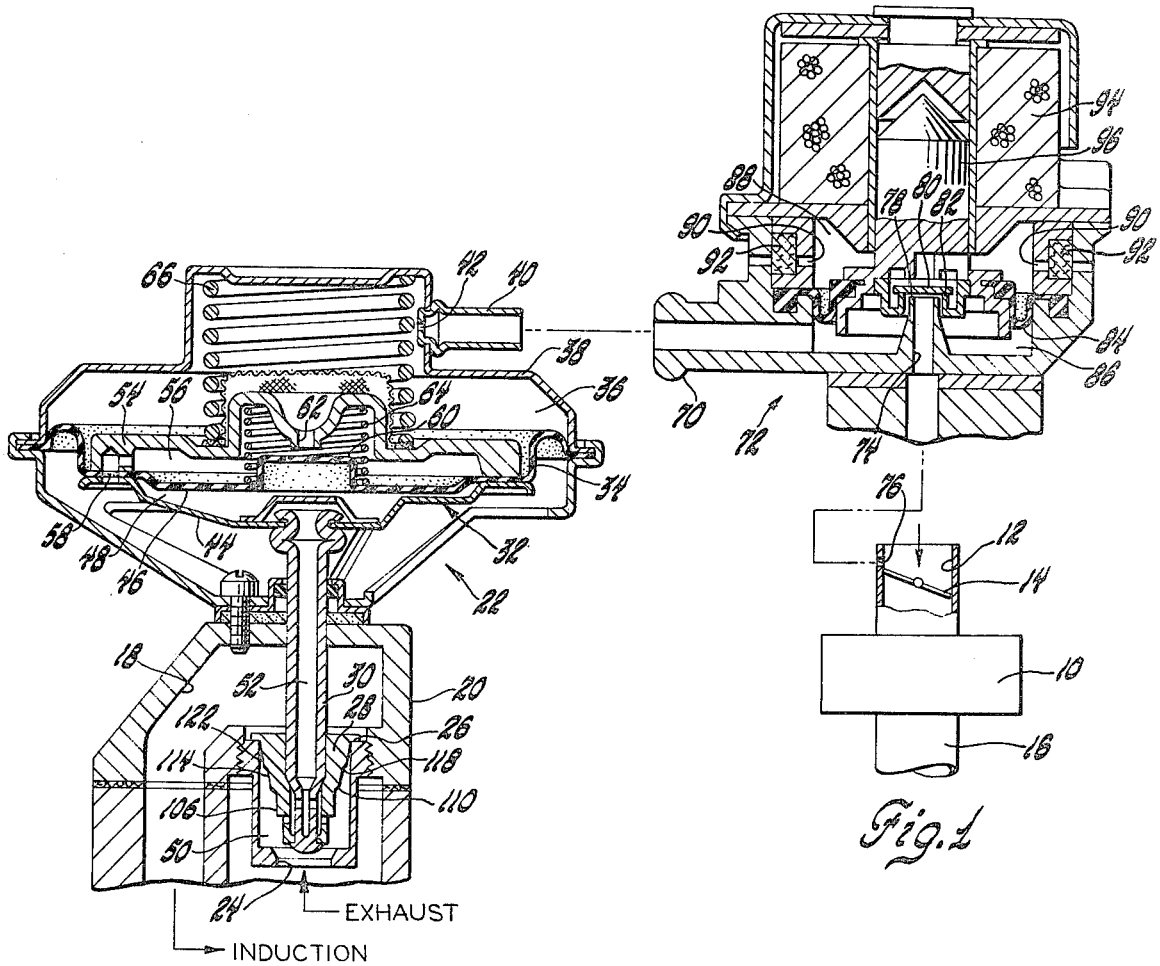

This invention relates to control of exhaust gas recirculation and provides a novel assembly for controlling exhaust gas recirculation in proportion to induction air flow and for decreasing the proportion when induction air flow exceeds a selected rate.

Recirculation of exhaust gases has been developed as a method for inhibiting formation of oxides of nitrogen during the combustion process in an internal combustion engine. In general, it is desired to recirculate exhaust gases at a rate proportional to the rate of engine induction air flow. To accomplish that purpose, exhaust gas recirculation (EGR) control units have included an exhaust gas recirculation control valve pintle positioned to maintain the pressure in the EGR passage upstream of the pintle equal to a reference pressure. Recirculation of exhaust gas has thus been varied with exhaust backpressure, which in turn varies as a function of induction air flow, to provide exhaust gas recirculation substantially proportional to induction air flow.

Such prior EGR control units generally included a transducer having an aperture sensing subatmospheric induction passage pressure, an air bleed sensing atmospheric pressure, and a bleed valve controlling air flow through the bleed to create an operating pressure which positioned the control valve pintle: the bleed valve opened the air bleed to increase the operating pressure which caused the control valve pintle to produce a smaller exhaust gas recirculation area when the induction air flow (and thus the engine exhaust backpressure) decreased and the pressure in the EGR passage accordingly started to fall below the reference pressure, and closed the air bleed which reduced the operating pressure and caused the control valve pintle to produce a larger exhaust gas recirculation area when the induction air flow (and thus the engine exhaust backpressure) increased and the pressure in the EGR passage accordingly started to rise above the reference pressure.

In such units, the control valve pintle would be retracted to provide a maximum exhaust gas recirculation area when the operating pressure dropped to a certain level. Thereafter, a reduction in the operating pressure by the transducer—in an attempt to match an increase in induction air flow—could not effect an increase in exhaust gas recirculation area, and the proportion of exhaust gas recirculation to induction air flow would decrease. Such a decrease in the proportion of exhaust gases recirculated is desirable to provide maximum power as the engine approaches wide open throttle operation.

In some applications, however, it may be desired to reduce the proportion of exhaust gases recirculated at a selected induction air flow rate under some operating conditions and at other induction air flow rates under other operating conditions. This invention provides an EGR control assembly which has a unit that regulates the pressure signal provided to an EGR control unit to prevent the operating pressure from dropping below a lower limit which may be varied as desired. The EGR control assembly provided by this invention thus produces a maximum exhaust gas recirculation area at an operating pressure determined by the regulating unit, and a further increase in induction air flow results in a decrease in the proportion of exhaust gases recirculated.

Figure 2:
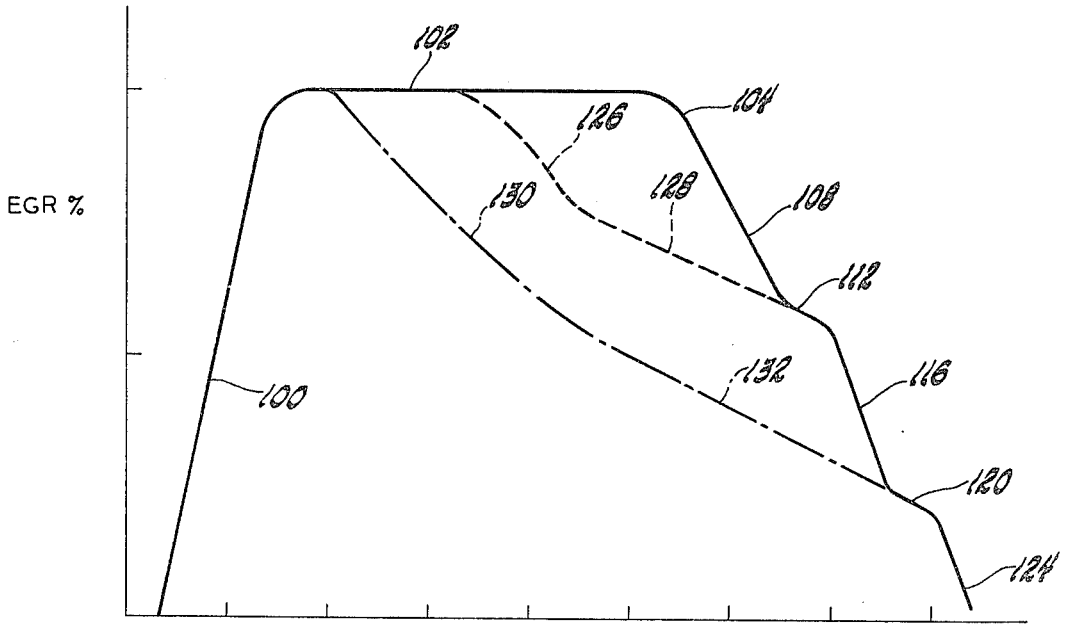

The details as well as other features and advantages of this invention are set forth in the remainder of the specification and are shown in the drawing, in which:

FIG. 1 is a schematic view of an exhaust gas recirculation control assembly employing a preferred embodiment of this invention; and FIG. 2 graphically illustrates the operation of the FIG. 1 embodiment.

Referring first to FIG. 1, an internal combustion engine 10 has an air induction passage 12, a throttle 14 controlling induction air flow through passage 12, and an exhaust passage 16. An exhaust gas recirculation (EGR) passage 18 extends from exhaust passage 16 through the body 20 of an EGR control unit 22 and then to induction passage 12 downstream of throttle 14.

An orifice 24 is disposed in EGR passage 18 upstream of a valve seat 26. A control valve pintle 28 is associated with valve seat 26 and has a stem 30 secured to a transducer 32 which is carried on an annular operating diaphragm 34.

Operating diaphragm 34 forms a portion of an operating pressure chamber 36 which is closed by a cover 38. Cover 38 has a fitting 40 with an aperture 42 for sensing a subatmospheric pressure signal.

Transducer 32 includes a lower plate 44, and an inward extension of annular operating diaphragm 34 forms a control diaphragm 46 which cooperates with plate 44 to define a control pressure chamber 48. Control pressure chamber 48 senses the pressure in the zone 50 of EGR passage 18 between orifice 24 and valve seat 26 through the passage 52 formed by hollow valve stem 30.

Transducer 32 also includes an upper plate 54 which cooperates with control diaphragm 46 to define an atmospheric pressure chamber 56. Chamber 56 has an inlet 58 for receiving air at atmospheric pressure.

Control diaphragm 46 carries a bleed valve 60 which controls air flow into control pressure chamber 36 through a bleed 62 formed in upper plate 54.

During operation, an increase in pressure in zone 50 is sensed in control pressure chamber 48, and control diaphragm 46 lifts bleed valve 60 against the bias of a spring 64 to obstruct air flow through bleed 62. The operating pressure in chamber 36 is then reduced by the subatmospheric pressure signal sensed through aperture 42, and operating diaphragm 34 is raised against the bias of a spring 66 to lift control valve pintle 28 from valve seat 26. The resulting increase in the exhaust gas recirculation area between control valve pintle 28 and valve seat 26 provides increased exhaust gas recirculation, and the pressure in zone 50 decreases to balance the control pressure in chamber 48 with the reference pressure created by the bias of spring 64 and atmospheric pressure in chamber 56.

Upon a decrease in the pressure in zone 50, spring 64 and the atmospheric pressure in chamber 56 lower diaphragm 46, moving bleed valve 60 away from air bleed 62 to permit air flow through bleed 62 into chamber 36. The increased operating pressure in chamber 36 then allows spring 66 to lower operating diaphragm 34 and valve pintle 28. The resulting decrease in the exhaust gas recirculation area reduces exhaust gas recirculation, and the pressure in zone 50 increases to balance the control pressure in chamber 48 with the reference pressure.

EGR control unit 22 thus positions control valve pintle 28 to produce an exhaust gas recirculation area which provides exhaust gas recirculation at rates establishing the pressure in zone 50 necessary to maintain the control pressure in chamber 48 equal to the reference pressure.

When the pressure in zone 50 equals the reference pressure, the flow of exhaust gases into zone 50 varies as a function of the exhaust backpressure in passage 16. Since the exhaust backpressure is a function of the flow through engine 10—that is, a function of the exhaust gas flow through passage 16 and thus the induction air flow through passage 12—exhaust gas recirculation through EGR passage 18 will be proportional to the induction air flow through passage 12.

It will be appreciated that over a range of pressure signals sensed by aperture 42, variations in the pressure signal do not affect exhaust gas recirculation—for if the operating pressure in chamber 36 causes operating diaphragm 34 to move control valve pintle 28 from that position which provides exhaust gas recirculation at the rate necessary to maintain the control pressure in chamber 48 equal to the reference pressure, transducer 32 will restore the operating pressure in chamber 36 to the level necessary to return control valve pintle 28 to that position.

However, when the operating pressure drops to a certain level—for example, a vacuum of 6.5 inches Hg—upper plate 54 of transducer 32 engages cover 38 and a further reduction in the operating pressure cannot produce an increase in the exhaust gas recirculation area. A further increase in induction air flow accordingly will be accompanied by a decrease in the proportion of exhaust gases recirculated.

Fitting 40 of EGR control unit 22 is connected to the fitting 70 of a regulating unit 72. Regulating unit 72 has a port 74 which senses the pressure at a port 76 in induction passage 12 adjacent the edge of throttle 14. Port 76 senses the subatmospheric induction passage pressure downstream of throttle 14 during open throttle operation and the substantially atmospheric pressure upstream of throttle 14 during idle and other closed throttle modes of operation.

Port 74 is surrounded by a valve seat 78 which is controlled by a regulating valve disc 80. Another valve seat 82 surrounds valve seat 78 and also is controlled by regulating valve disc 80. A regulating diaphragm 84 carries valve seat 82 and defines a portion of a signal chamber 86 which surrounds valve seat 78. The region 88 above regulating diaphragm 84 senses atmospheric pressure through ports 90 and a filter medium 92.

Regulating unit 72 maintains the upwardly acting pressure signal in chamber 86 equal to a downwardly acting limit pressure on regulating diaphragm 84. If the pressure signal in chamber 86 exceeds the limit pressure, regulating diaphragm 84 raises valve seat 82 which lifts regulating valve disc 80 from valve seat 78 and allows the subatmospheric pressure sensed by port 74 to reduce the pressure signal in chamber 86. If the limit pressure exceeds the pressure signal in chamber 86, regulating diaphragm 84 is lowered to seat regulating valve disc 80 across valve seat 78 and to drop valve seat 82 from valve disc 80, thus allowing the atmospheric pressure from port 90 to increase the pressure signal in chamber 86.

The limit pressure on regulating diaphragm 84 is formed both by the atmospheric pressure in region 88 and by the electromagnetic force created between a solenoid coil 94 and an armature 96 carried by regulating diaphragm 84. The electromagnetic force and thus the limit pressure is determined by current in coil 94: with a low current in coil 94, armature 96 will provide only a weak upward force opposing the atmospheric pressure in region 88, whereas with high current in coil 94, armature 96 will provide a stronger upward force opposing the atmospheric pressure in region 88. The limit pressure on regulating diaphragm 84 thus varies inversely with current in coil 94.

With high current in coil 94, the limit pressure on regulating diaphragm 84 is far less than atmospheric, and regulating diaphragm 84 raises valve seat 82 to engage valve disc 80 and holds valve disc 80 away from valve seat 78. During most conditions of engine operation, the pressure created at port 76 does not become far less than atmospheric, and regulating unit 72 then passes the pressure created at port 76 as the pressure signal to EGR control unit 22.

Operation with high current in coil 94 is illustrated by the solid line of FIG. 2 showing variations in the proportion of exhaust gases recirculated (on the vertical axis) with variations in the pressure in induction passage 12 downstream of throttle 14 (on the horizontal axis). The line rises at 100 as throttle 14 traverses port 76 and the pressure created at port 76 drops below atmospheric pressure. As throttle 14 opens further to increase induction air flow, the induction passage pressure rises but EGR control unit 22 maintains exhaust gas recirculation as a proportion of induction air flow as at 102. When upper plate 54 engages cover 38, EGR control unit 22 cannot produce the increased exhaust gas recirculation area necessary to maintain exhaust gas recirculation proportional to induction air flow, and the increased induction passage pressure which occurs with a further increase in induction air flow thus is accompanied by a decrease in the proportion of exhaust gas recirculation as at 104. As induction air flow continues to increase and the induction passage pressure rises above the 6.5 inches Hg vacuum mentioned above, spring 66 displaces control valve pintle 28 toward valve seat 26, first moving the cylindrical portion 106 through valve seat 26 to produce the effect shown at 108, then moving the step 110 through valve seat 26 to produce the effect shown at 112, then moving the conical portion 114 through valve seat 26 to produce the effect shown at 116, then moving the step 118 through valve seat 26 to produce the effect shown at 120, then moving the conical portion 122 through valve seat 26 to produce the effect shown at 124, and finally engaging control valve pintle 28 with valve seat 26 to shut off exhaust gas recirculation.

As current in coil 94 is reduced, the limit pressure on regulating diaphragm 84 rises, and regulating unit 72 prevents the pressure signal sensed by aperture 42 from dropping below the limit pressure. As the limit pressure rises above the 6.5 inches Hg vacuum mentioned, movement of upper plate 54 toward cover 38 is limited—reducing the maximum area available for exhaust gas recirculation.

Thus when current in coil 94 is selected to establish a limit pressure of 4.5 inches Hg below atmospheric pressure, the proportion of exhaust gases recirculated is indicated by the solid lines 100 and 102, the broken lines 126 and 128, and the solid lines 112, 116, 120 and 124. When the current in coil 94 is selected to establish a limit pressure of 2.5 inches Hg below atmospheric pressure, the proportion of exhaust gases recirculated is indicated by the solid lines 100 and 102, the broken lines 130 and 132, and the solid lines 120 and 124.

In view of the foregoing, it will be appreciated that EGR control unit 22 provides exhaust gas recirculation as a proportion of induction air flow until the operating pressure in chamber 36 is reduced to the limit pressure established by regulating unit 72. Any further increase in induction air flow (and thus in exhaust backpressure) causes an increase in the control pressure in zone 50 and chamber 48, but closure of bleed valve 60 does not result in a decrease in the operating pressure. Thus the exhaust gas recirculation area cannot increase, and the proportion of exhaust gas recirculation to induction air flow begins to decrease.

The embodiments of the invention in which an exclusive property or privilege is claimed are defined as follows:

1. An exhaust gas recirculation control assembly for an engine having an induction passage for induction air flow and a recirculation passage for exhaust gas recirculation to said induction passage, said assembly comprising a diaphragm defining a portion of an operating pressure chamber, said chamber having an aperture for sensing a subatmospheric pressure signal and also having an air bleed and combining the pressures sensed through said aperture and said air bleed to form an operating pressure, a control valve in said recirculation passage and positioned by said diaphragm to produce an exhaust gas recirculation area in inverse relation to said operating pressure, and a valve varying flow through said bleed to create an operating pressure for positioning said control valve to provide exhaust gas recirculation in accordance with engine operating conditions, and wherein the improvement comprises means defining a signal chamber having ports for sensing subatmospheric pressure in said induction passage and atmospheric pressure and combining the pressures sensed through said ports to create said subatmospheric pressure signal, regulating valve means modulating said ports for preventing said signal from dropping below a lower limit to thereby establish a maximum exhaust gas recirculation area, and means for varying said lower limit and thus said maximum area to thereby decrease the proportion of exhaust gas recirculation to induction air flow when induction air flow exceeds a selected rate.

2. An exhaust gas recirculation control assembly for an engine having an induction passage for induction air flow and a recirculation passage for exhaust gas recirculation to said induction passage, said assembly comprising a diaphragm defining a portion of an operating pressure chamber, said chamber having an aperture for sensing a subatmospheric pressure signal and also having an air bleed and combining the pressures sensed through said aperture and said air bleed to form an operating pressure, a control valve in said recirculation passage and positioned by said diaphragm to produce an exhaust gas recirculation area in inverse relation to said operating pressure, a control diaphragm defining a portion of a control pressure chamber having means for sensing the pressure in a zone of said recirculation passage, and a bleed valve positioned by said control diaphragm to obstruct flow through said bleed when the control pressure in said control pressure chamber exceeds a reference pressure, whereby said control valve is positioned to provide exhaust gas recirculation at rates which establish the pressure in said zone necessary to maintain said control pressure equal to said reference pressure and thus provide exhaust gas recirculation as a proportion of induction air flow, and wherein the improvement comprises means defining a signal chamber having ports for sensing subatmospheric pressure in said induction passage and atmospheric pressure and combining the pressures sensed through said ports to create said subatmospheric pressure signal, regulating valve means modulating said ports for preventing said signal from dropping below a lower limit to thereby establish a maximum exhaust gas recirculation area, and means for varying said lower limit and thus said maximum area to thereby decrease the proportion of exhaust gas recirculation to induction air flow when induction air flow exceeds a selected rate.

3. An exhaust gas recirculation control assembly for an engine having an induction passage for induction air flow and a recirculation passage for exhaust gas recirculation to said induction passage, said assembly comprising a diaphragm defining a portion of an operating pressure chamber, said chamber having an aperture for sensing a subatmospheric pressure signal and also having an air bleed and combining the pressures sensed through said aperture and said air bleed to form an operating pressure, a control valve in said recirculation passage and positioned by said diaphragm to produce an exhaust gas recirculation area in inverse relation to said operating pressure, a control diaphragm defining a portion of a control pressure chamber having means for sensing the pressure in a zone of said recirculation passage, and a bleed valve positioned by said control diaphragm to obstruct flow through said bleed when the control pressure in said control pressure chamber exceeds a reference pressure, whereby said control valve is positioned to provide exhaust gas recirculation at rates which establish the pressure in said zone necessary to maintain said control pressure equal to said reference pressure and thus provide exhaust gas recirculation as a proportion of induction air flow, and wherein the improvement comprises means defining a signal chamber having ports for sensing subatmospheric pressure in said induction passage and atmospheric pressure and combining the pressures sensed through said ports to create said subatmospheric pressure signal, a regulating diaphragm sensing said pressure signal, a solenoid coil, an armature responsive to current in said coil for creating a limit pressure on said regulating diaphragm opposing said pressure signal on said regulating diaphragm, and regulating valve means positioned by said regulating diaphragm to modulate said ports for preventing said signal from dropping below said limit to thereby establish a maximum exhaust gas recirculation area, whereby the proportion of exhaust gas recirculation to induction air flow is decreased at an induction air flow rate determined by current in said coil.

* * * * *